US010253967B2

(12) United States Patent
Hu et al.

(10) Patent No.: US 10,253,967 B2
(45) Date of Patent: Apr. 9, 2019

(54) LIGHT-EMITTING BULB

(71) Applicant: EPISTAR CORPORATION, Hsinchu (TW)

(72) Inventors: Wei-Chiang Hu, Hsinchu (TW); Chiu-Lin Yao, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 20 days.

(21) Appl. No.: 14/676,088

(22) Filed: Apr. 1, 2015

(65) Prior Publication Data

US 2016/0290622 A1 Oct. 6, 2016

(51) Int. Cl.

| | |
|---|---|
| ***F21K 9/238*** | (2016.01) |
| ***F21V 29/83*** | (2015.01) |
| ***F21V 3/06*** | (2018.01) |
| ***F21K 9/23*** | (2016.01) |
| ***F21K 9/232*** | (2016.01) |
| ***F21K 9/66*** | (2016.01) |

(52) U.S. Cl.

CPC ..... *F21V 29/83* (2015.01); *F21K 9/23* (2016.08); *F21K 9/232* (2016.08); *F21K 9/238* (2016.08); *F21K 9/66* (2016.08); *F21V 3/06* (2018.02)

(58) Field of Classification Search

CPC . F21K 9/00; F21K 9/10; F21K 9/1355; F21K 9/232; F21K 9/66; F21K 9/237; F21K 9/238; F21K 9/235; F21V 17/00; F21V 17/004; F21V 17/006; F21V 17/005; F21V 19/003; F21V 29/50; F21V 29/83; F21V 3/0409; F21V 19/0015; F21V 3/02; F21V 17/101; F21V 3/06; F21V 17/104; F21V 17/107; F21V 17/108; F21V 17/16; F21V 19/0005; F21V 19/00; F21Y 2101/02; F21Y 2115/10; F21Y 2107/00; F21Y 2107/90; H05B 33/06

See application file for complete search history.

(56) References Cited

U.S. PATENT DOCUMENTS

| | | | | |
|---|---|---|---|---|
| 6,227,679 | B1 * | 5/2001 | Zhang | F21V 3/00 257/E25.028 |
| 2010/0060132 | A1 * | 3/2010 | Liu | F21V 29/02 313/46 |
| 2010/0097798 | A1 * | 4/2010 | Young | F21V 3/0445 362/235 |
| 2010/0164348 | A1 * | 7/2010 | Huang | F21V 15/01 313/46 |
| 2011/0037368 | A1 * | 2/2011 | Huang | F21V 29/02 313/46 |
| 2011/0141748 | A1 * | 6/2011 | Lee | F21V 19/0025 362/363 |

(Continued)

*Primary Examiner* — Anh T Mai
*Assistant Examiner* — Fatima N Farokhrooz
(74) *Attorney, Agent, or Firm* — Muncy, Geissler, Olds & Lowe, P.C.

(57) ABSTRACT

This disclosure discloses a light-emitting bulb. The light-emitting bulb comprises: a first light-emitting device comprising a first light-emitting unit and a first cover covering the light-emitting unit; a second cover comprising a bottom end and a lateral portion surrounding the first light-emitting device; a first opening provided in the bottom end of the second cover; and a second opening provided in the lateral portion of the second cover.

19 Claims, 9 Drawing Sheets

(56) References Cited

U.S. PATENT DOCUMENTS

| | | | | |
|---|---|---|---|---|
| 2011/0163681 | A1* | 7/2011 | Dau | F21K 9/235 315/191 |
| 2012/0243230 | A1* | 9/2012 | Carroll | F21K 9/13 362/249.02 |
| 2012/0287651 | A1* | 11/2012 | Hirata | F21V 29/02 362/373 |
| 2013/0058100 | A1* | 3/2013 | DeRose | F21V 29/30 362/294 |
| 2013/0187528 | A1* | 7/2013 | Bailey | F21V 13/04 313/46 |
| 2013/0194802 | A1* | 8/2013 | Kim | F21K 9/56 362/245 |
| 2013/0208469 | A1 | 8/2013 | Progl | |
| 2014/0240955 | A1* | 8/2014 | Terasaki | F21V 29/22 362/84 |
| 2014/0268802 | A1* | 9/2014 | Sun | F21V 29/004 362/294 |
| 2015/0003039 | A1* | 1/2015 | Liu | F21K 9/00 362/84 |
| 2016/0053948 | A1* | 2/2016 | Wang | F21K 9/232 362/84 |
| 2016/0369952 | A1* | 12/2016 | Weekamp | G02B 6/0003 |

* cited by examiner

LIGHT-EMITTING BULB

BACKGROUND

Technical Field

The present disclosure relates to a light-emitting bulb, and in particular to a light-emitting bulb comprising a cover with an opening.

Description of the Related Art

Recently, a light-emitting bulb has been used in household appliances. In operation, the light-emitting bulb can generate light and heat. If heat is not properly dissipated, temperature of the light-emitting bulb will be increased, which may adversely affect light intensity, lifetime, etc. Therefore, there is still a need to improve heat dissipation.

SUMMARY OF THE DISCLOSURE

The present disclosure provides a light-emitting bulb.

The light-emitting bulb comprises: a first light-emitting device comprising a first light-emitting unit and a first cover covering the light-emitting unit; a second cover comprising a bottom end and a lateral portion surrounding the first light-emitting device; a first opening provided in the bottom end of the second cover; and a second opening provided in the lateral portion of the second cover.

BRIEF DESCRIPTION OF THE DRAWING

The accompanying drawings are included to provide easy understanding of the application. The drawings illustrate the embodiments of the application and, together with the description, serve to illustrate the principles of the application.

DETAILED DESCRIPTION OF THE EMBODIMENTS

To better and concisely explain the disclosure, the same name or the same reference number given or appeared in different paragraphs or figures along the specification should has the same or equivalent meanings while it is once defined anywhere of the disclosure.

The following shows the description of embodiments of the present disclosure in accordance with the drawings.

Figure 1:
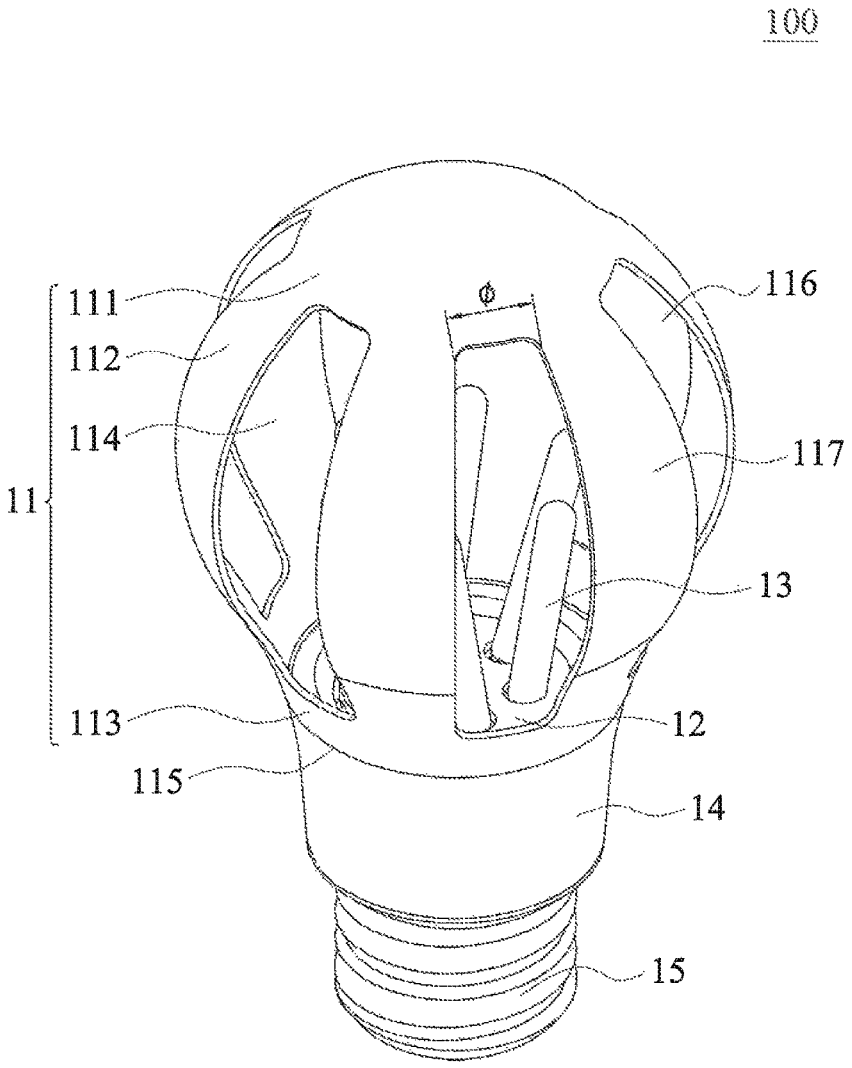
FIG. 1 shows a perspective view of a light-emitting bulb in accordance with a first embodiment of the present disclosure.

FIG. 1 discloses a perspective view of a light-emitting bulb 100 in accordance with the first embodiment of the present disclosure. The light-emitting bulb 100 comprises a bulb cover 11, a board 12, a plurality of light-emitting devices 13 arranged on the board 12, a heat sink 14, and an electrical connector 15. The bulb cover 11 has a top portion 111, a lateral portion 112, and a bottom end 113 which cooperate with each other to define a chamber 114. A first opening 115 is provided at the bottom end 113 for passing the light-emitting devices 13 and the board 12 therethrough such that the light-emitting devices 13 can be accommodated in the chamber 114. The board 12 is occupied at the first opening 115 and connected to the bottom end 113 of the bulb cover 11. A plurality of second openings 116 is provided on the lateral portion 112 of the bulb cover 11. In this embodiment, the second openings 116 are elongated along a direction from the top portion 111 to the bottom end 113. Furthermore, the bulb cover 11 comprises a plurality of separated ribs 117 extending from the top portion 111 to the bottom end 113. Two adjacent ribs 117 are spaced apart from each other by the second opening 16. The second openings 116 and the ribs 117 are cooperated to form the lateral portion 112. With the second openings 116, air can move between the chamber 114 and ambient environment, thereby heat produced from the light-emitting devices 13 can be dissipated by heat convection so as to reduce the temperature of the light-emitting devices 13. An area ratio of the second opening 116 to the bulb cover 11 can be set in a range of 0.1~0.9, or 0.3~0.7. The second openings 116 can have a maximum width (Φ) of 5 mm~10 mm in order to avoid directly touching the light-emitting devices 13 by hand therethrough. For drop test consideration, the bulb cover 11 is chosen to be made by polypropylene, polybutylene terephthalate, poly(methyl methacrylate), or tempered glass.

Figure 2A:
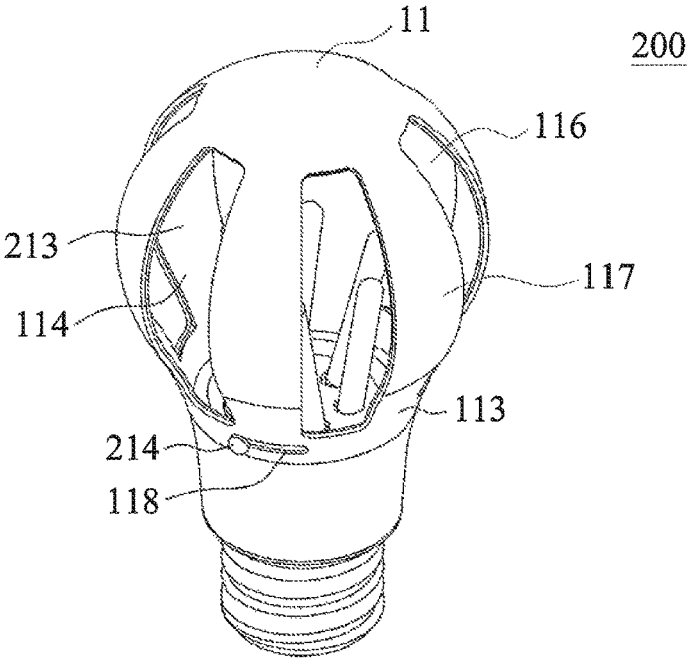
FIG. 2A shows a perspective view of a light-emitting bulb in accordance with a second embodiment of the present disclosure, wherein the light-emitting bulb is in an open state.
Figure 2B:
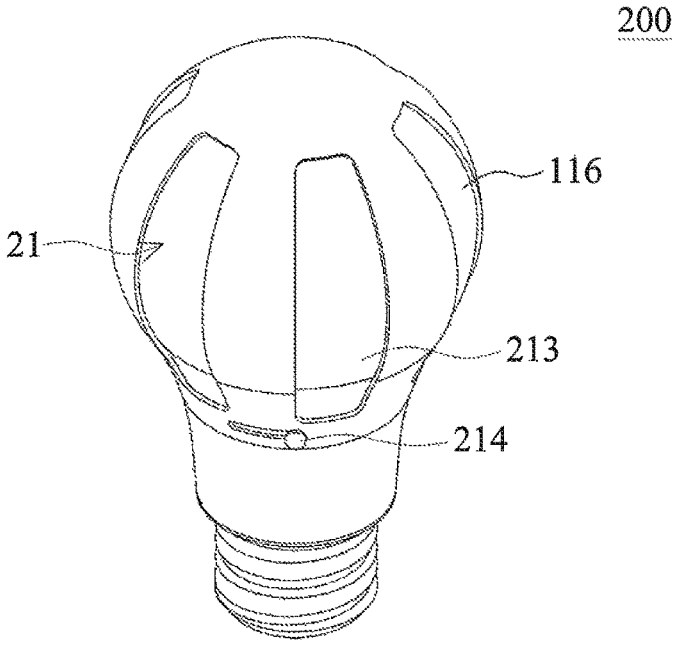
FIG. 2B shows a perspective view of the light-emitting bulb in accordance with a second embodiment of the present disclosure wherein the light-emitting bulb is in a closed state.
Figure 2C:
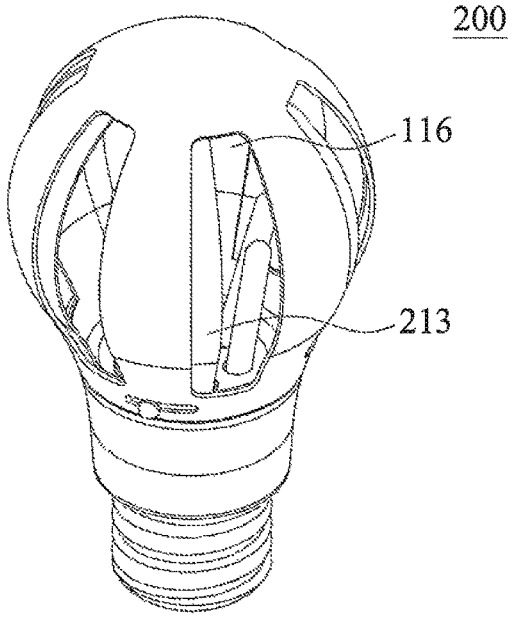
FIG. 2C shows a perspective view of the light-emitting bulb in accordance with a second embodiment of the present disclosure wherein the light-emitting bulb is in a semi-open state.
Figure 2D:
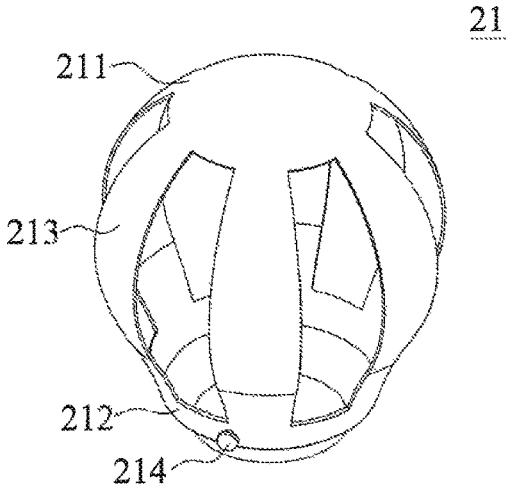
FIG. 2D shows a perspective view of a shielding structure in accordance with the second embodiment of the present disclosure.

FIGS. 2A~2C shows a perspective view of a light-emitting bulb 200 in accordance with the second embodiment of the present disclosure. FIG. 2D shows a perspective view of a shielding structure in accordance with the second embodiment of the present disclosure. The light-emitting bulb 200 is similar to the light-emitting bulb 100. The devices or elements with similar or the same symbols represent those with the same or similar functions and could be omitted in the following explanation for brevity. As shown in FIGS. 2A~2D, the light-emitting bulb 200 further includes a shield structure 21 configured to optionally shield or unshield the second opening 116. Specifically, as shown in FIG. 2D, the shielding structure 21 has a shape substantially identical to that of the bulb cover 11 but has a size smaller than that of the cover 11. The shielding structure 21 includes an upper part 211, a lower part 212, and a plurality of shield plates 213 extending between the upper part 211 and the lower part 213, a bump 214 provided in the lower part 212. As shown in FIG. 2A, the bulb cover 11 further has a slot 118 provided in the bottom end 113. In assembly, the shield structure 21 is mounted inside the chamber 114 and the bump 214 passes through the slot 118. Since the bump 214 has a head larger than the size of the slot 118, the bump 214 is confined and movable in the slot 118 after the assembly. As shown in FIG. 2A, the light-emitting bulb 200 is in an open state where the shield plates 213 overlap the ribs 117 and the light-emitting device 13 can be seen via the second openings 116. As shown in FIG. 2B, when moving the bump 214, the shield structure 21 is also moved such that the shield plates 213 shield the second openings 116 wherein the light-emitting bulb 200 is in a closed state and the light-emitting device 13 cannot be seen. As shown in FIG. 2C, the shield plates 213 can partially overlap and shield the second openings 116 wherein the light-emitting bulb 200 is in a semi-open state.

As shown in FIG. 1, the board 12 has a plurality of holes. The light-emitting devices 13 can be inserted into the holes. The light-emitting devices 13, for example, include a first light-emitting device and a second light-emitting device. The first light-emitting device is arranged with respect to the board 12 in a first inclined angle. The second light-emitting device arranged with respect to the board 12 in a second inclined angle different from the first inclined angle. The first light-emitting device and the second light-emitting device are inclined with respect to the board 12 toward opposite directions.

Since some light does not pass through the shield plates 213, the light-emitting bulb 200 which is in the open state or in the semi-open state has a higher light intensity than that in the closed state. In addition, the light-emitting bulb 200 which is in the closed state has a more uniform light distribution pattern than that in the open state or in the semi-open state. Therefore, by means of the shield structure 21, the light intensity and the light distribution pattern of the light-emitting bulb 200 can be adjustable. In this embodiment, the shield plates 212 can be manually or mechanically controlled to shield or unshield the second openings 116. However, the shield structure 21 can also be controlled by an electrical method.

Figure 3A:
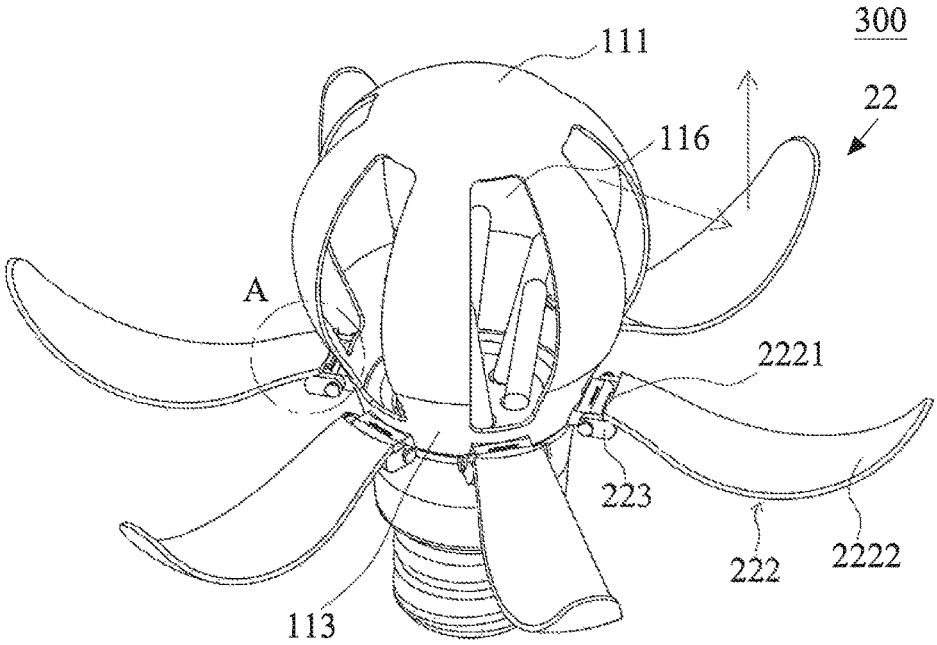
FIG. 3A shows a perspective view of a light-emitting bulb in accordance with a third embodiment of the present disclosure, wherein the light-emitting bulb is in an open state.
Figure 3B:
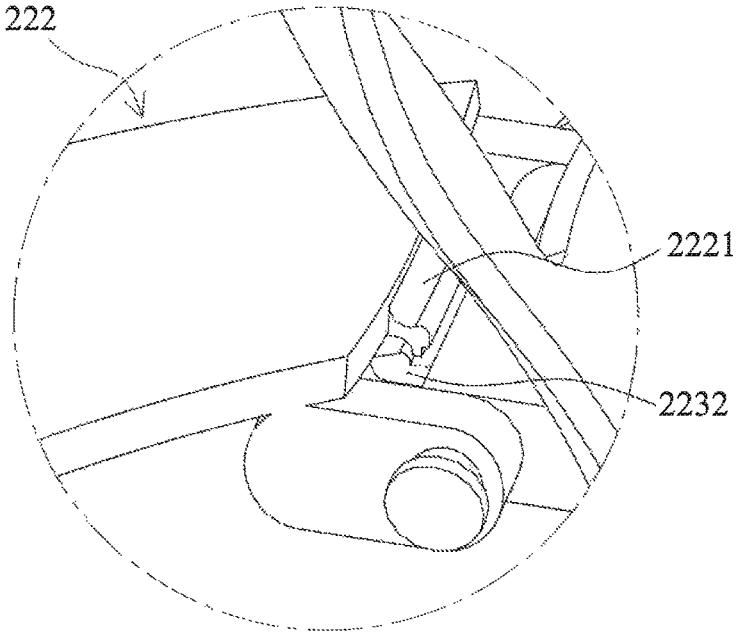
FIG. 3B shows an enlarge view of a circle A in FIG. 3A.
Figure 3C:
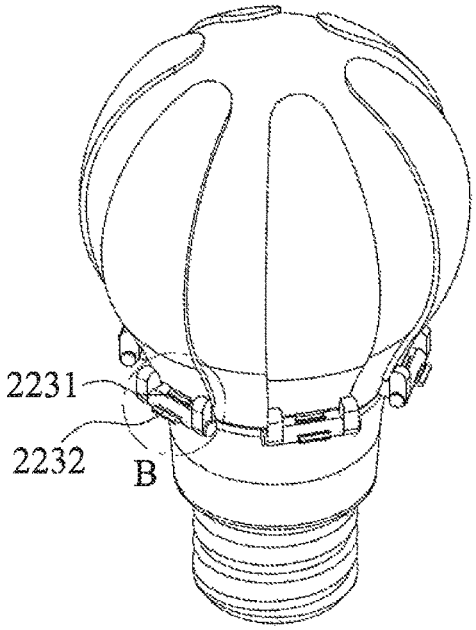
FIG. 3C shows a perspective view of a light-emitting bulb in accordance with a third embodiment of the present disclosure, wherein the light-emitting bulb is in a closed state.
Figure 3D:
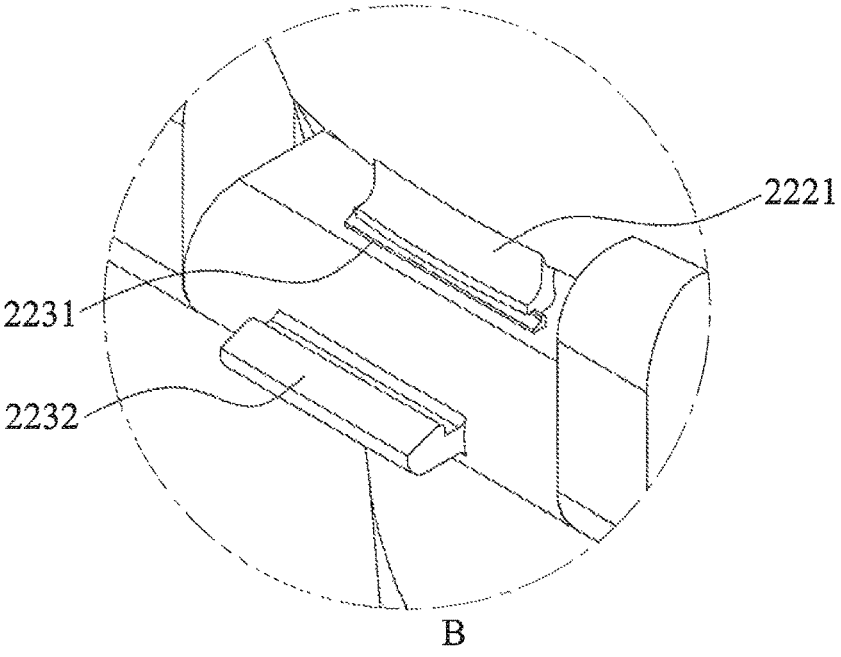
FIG. 3D shows an enlarge view of a circle B in FIG. 3A.
Figure 3E:
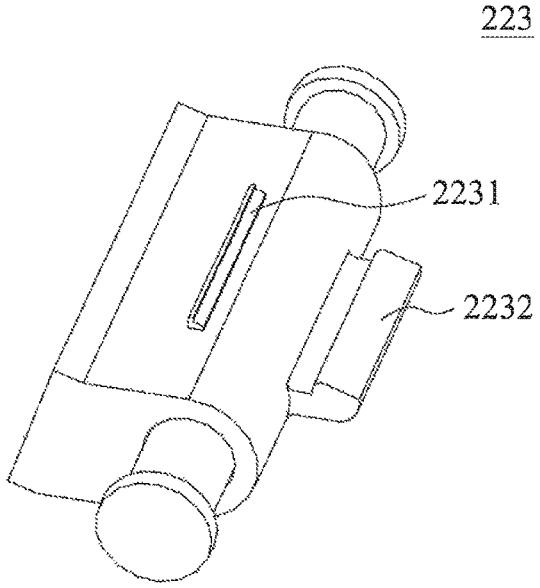
FIG. 3E shows a perspective view of a locking member in accordance with the third embodiment of the present disclosure.

FIG. 3A shows a perspective view of a light-emitting bulb 300 in accordance with the third embodiment of the present disclosure. The devices or elements with similar or the same symbols represent those with the same or similar functions and could be omitted in the following explanation for brevity. In the embodiment, the shield structure 22 includes a plurality of shield plates 222 and a plurality of locking members 223. The locking members 223 are secured to the bottom end 113 at the positions corresponding to the second openings 116. The shield plates 222 merely have a first end 2221 pivotably connected to the locking members 223. Specifically, as shown in FIG. 3E, the locking member 223 includes a first protrusion 2231 and a second protrusion 2232. In an open state, as shown in FIGS. 3A and 3B, the first end 2221 abuts against the second protrusion 2232 in a splice-joint configuration to maintain an open position. In a closed state, as shown in FIGS. 3C and 3D, the first end 2221 abuts against the first protrusion2231 in a splice-joint configuration to maintain a closed position. Likewise, by means of the shield structure 22, the light intensity and the light distribution pattern of the light-emitting bulb 300 can be adjustable. In another embodiment, the shield plate 222 can include a reflective coating on inner surface 2222 for directing the light (see the arrow in FIG. 3A) from the light-emitting device 13 toward the top portion 111.

Figure 4A:
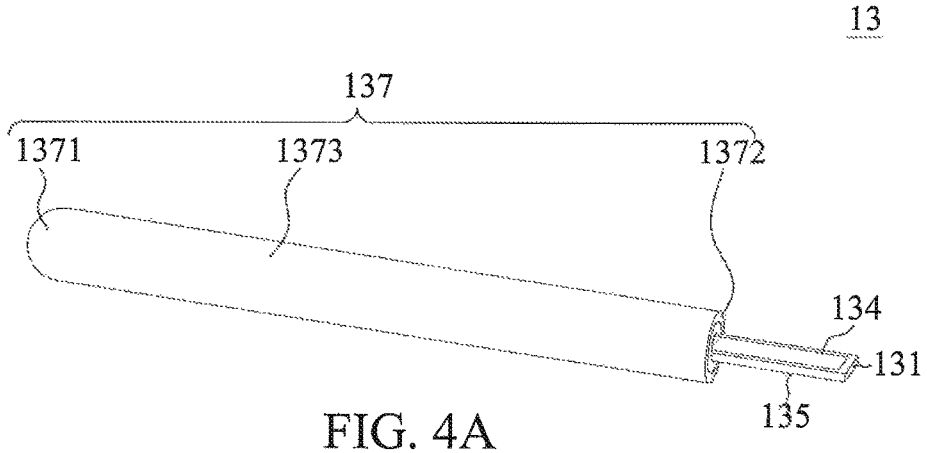
FIG. 4A shows a perspective view of one embodiment of a light-emitting device.
Figure 4B:
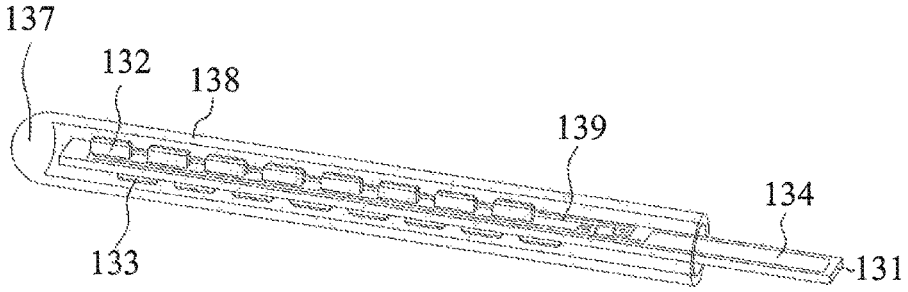
FIGS. 4B and 4C show different perspective views of a light-emitting device with a transparent cover.
Figure 4C:
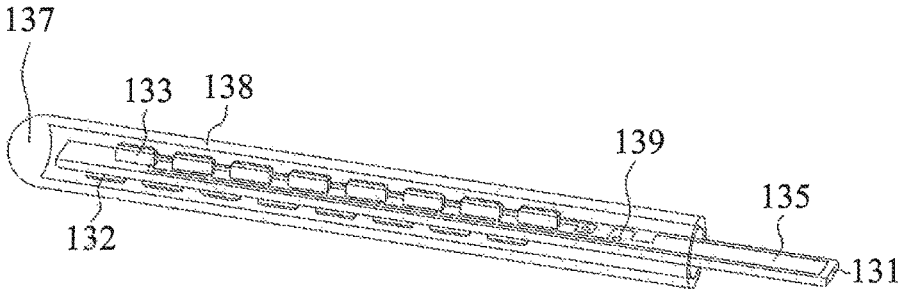
Figure 4D:
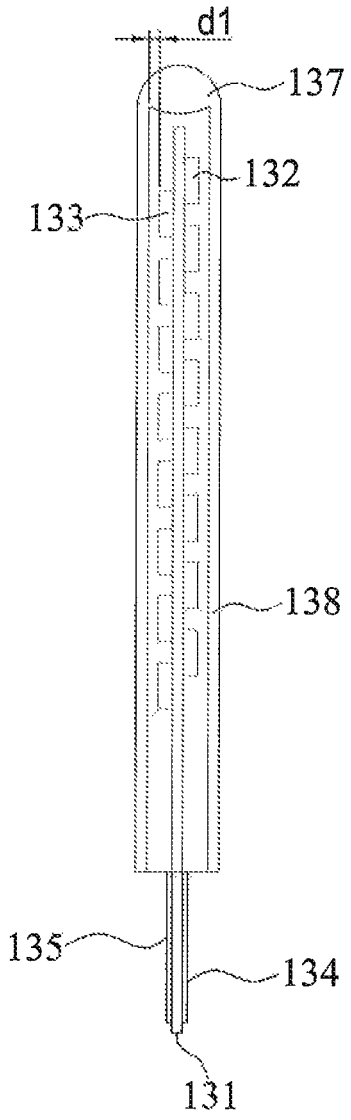
FIG. 4D shows a cross-sectional view of the light-emitting device of FIG. 4B.

FIG. 4A shows a perspective view of one embodiment of the light-emitting device 13. FIGS. 4B and 4C show different perspective views while a plurality of light-emitting units 132, 133 inside a tube cover is visible. FIG. 4D shows a cross-sectional view of the light-emitting device 13. Referring to FIGS. 4A~4C, the light-emitting device 13 includes a carrier 131, a plurality of light-emitting units 132,133 arranged on the opposite sides of the carrier 131, two electrode plates 134, 135 formed on the opposite sides of the carrier 131, and a tube cover 137. The tube cover 137 has a closed end 1371, an open end 1372 and a middle portion 1373 extending between the closed end 1371 and the open end 1372. The middle portion 1373 surrounds the light-emitting units 132, 133 to expose the electrode plates 134, 135 or a portion of the carrier out of the open end 1372. The electrode plates 134, 135 extend without beyond a side surface of the carrier 131. The two electrode plates 134, 135 are electrically connected to the light-emitting units 132,133 and an external power source (not shown). A circuit 139 is further formed on the carrier 131 to parallelly connect the light-emitting units 132, 133 with each other. In other embodiment, the light-emitting units can be connected to each other in series or in a bridge configuration. In this embodiment, the tube cover 137 is spaced apart from the light-emitting unit 132, 133 by a shortest distance (d1) of smaller than 2 mm. A sealing member 138 including a transparent or translucent substance filled within the tube cover 137 and entirely covers the light-emitting units 13 and partially covers the carrier 131. A plurality of wavelength conversion particles or/and a plurality of diffusing particles (not shown) is alternatively dispersed within the sealing member 138. The wavelength conversion particle includes aluminum oxide (such as YAG or TAG), silicate, vanadate, alkaline-earth metal silicate, alkaline-earth metal sulfide, alkaline-earth metal selenide, alkaline-earth metal gallium silicate, metal nitride, metal nitride oxide, a mixture of tungstate and molybdate, a mixture of oxide, quantum dot, or combinations thereof In this embodiment, the light-emitting unit 132, 133 can emit a blue light with a peak wavelength of 430 nm~480 nm, and some of the blue light is converted by the wavelength conversion particles to emit a yellow light with a peak wavelength of 570 nm~590 nm or a yellowish green light with a peak wavelength of 540 nm~570 nm. Furthermore, the yellow light or the yellowish green light is mixed with the unconverted blue light to produce a white light of 2500K~6500K. The diffusing particle includes $TiO_2$, ZnO, MN, or $ZrO_2$. It is noted that when the wavelength conversion particles and/or the diffusing particles are dispersed in the sealing member 138, the light-emitting units 132, 133 may be invisible.

Moreover, because heat generated from the light-emitting units 132, 133 can be conducted through the sealing member 138 and the tube cover 137 to ambient air, the light-emitting device 13 has a better hot/cold factor which is a ratio of the hot-state lighting efficiency to the cold-state lighting efficiency. To be more specific for the hot/cold factor, when the light-emitting device 13 is connected to an external source, in an initial state, a cold-state lighting efficiency (light output (lumen)/watt) is measured, hereinafter, in every period of time (e.g. 30 ms, 40 ms, 50 ms, 80 ms, or 100 ms), the lighting efficiency is measured. When a difference between the adjacent measured light emitting efficiencies is smaller than 3%, the latter light efficiency is defined as a hot-state lighting efficiency. In this embodiment, when the sealing member 138 is filled between the light-emitting units 132, 133 and the tube cover 137, the hot/cold factor of the light-emitting device is R1, and when the filler is not filled between the light-emitting units 132,133 and the tube cover 137, the hot/cold factor of the light-emitting device is R2, wherein a difference of R1 and R2 is larger than 20%.

It is noted that, with the second opening 116, any object inside the cover 11 can be directly viewed by human eyes. However, because of the tube cover 137 enclosing the light-emitting units 132, 133, a glare problem could be alleviated. In addition, with a safety requirement, the tube cover 137 has a fragility or hardness less than that of the bulb cover 11. The tube cover 137 includes diamond, glass, epoxy, quartz, acrylic resin, SiOx, $Al_2O_3$, ZnO or silicone.

Figure 5A:
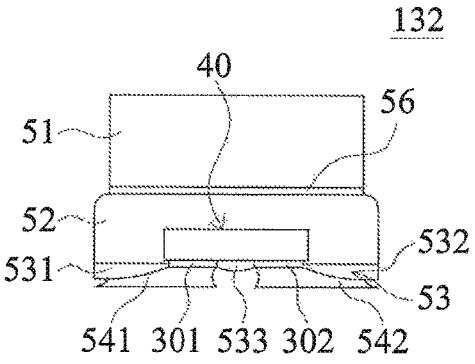
FIGS. 5A~5E show cross-sectional views of different embodiments of a light-emitting unit.

FIG. 5A shows a cross-sectional view of one embodiment of the light-emitting unit 132. The light-emitting unit 133 can have the same or different structure from the light-emitting unit 132. The light-emitting unit 132 includes a light-emitting element (flip-chip) 40 with a first electrode 301 and a second electrode 302, a first transparent structure 52 enclosing the light-emitting element 40, a second transparent structure 51 formed on the first transparent structure 52. A reflective layer 53 is formed on the first transparent structure 52 at a side opposite to the second transparent structure 51, and has a first portion 531, a second portion 532, and a third portion 533 between a first electrode 301 and a second electrode 302. The first portion 531 is adjacent to the first electrode 301 and has a height gradually increasing in a direction from the first electrode 301 to an edge of the first transparent structure 52. The second portion 532 is adjacent the second electrode 302 and has a shape similar to that of the first portion 531, therefore, the second portion 532 has a height gradually increasing in the direction from the second electrode 302 to another edge of the first transparent structure 52. The third portion 533 has a convex shape with a central region bulged outwards in a direction far away from the light-emitting element 40. In this embodiment, a first pad 541 is formed on the first portion 531 and the first electrode 301 and electrically connected to the first electrode 301. Specifically, the first pad 541 has a footprint area larger than that of the first electrode 301, thereby increasing a contact area with the circuit 139 on the carrier 131 (see FIG. 4B). A second pad 542 is formed on the second portion 532 and the second electrode 302 and electrically connected to the second electrode 302. Likewise, the second pad 542 has a footprint area larger than that of the second electrode 302, thereby increasing a contact area with the circuit 139 on the carrier 131 (see FIG. 4C).

Referring to FIG. 5A, the light-emitting unit 132 further includes a reflective structure 56 formed between the first transparent structure 52 and the second transparent structure 51. The reflective structure 56 can be a single layer or a multi-layer. If the reflective structure 56 is a single layer, the reflective structure 56 can be made of a conductive material or an insulating material. The conductive material includes but not limited to Ag, Al, and Au. The insulating material is such as a white paint which includes a plurality of diffusion particles dispersed in silicone-based or epoxy-based matrix. The diffusion particle is made of one or more materials. The material is such as $TiO_2$, ZnO, AlN, and $ZrO_2$. If the reflective structure 56 is a multi-layer, the reflective structure 56 can include a plurality of metal oxide layers (made of one or more materials, such as $SiO_2$, $Al_2O_3$ and $Si_3N_4$) or semiconductor layers (made of one or more materials, such as GaN, AlGaN, AlInGaN, AlAS, AlGaAs and GaAs) with an alternately-arranged layer structure, such as a Distributed Bragg Reflector structure. Alternatively, the reflective structure 56 can include a plurality of metal layers. The metal layer can be made of one or more reflective metals, such as Ag, Al, Au, Ti, Cr, Ni, and an alloy thereof.

Figure 5B:
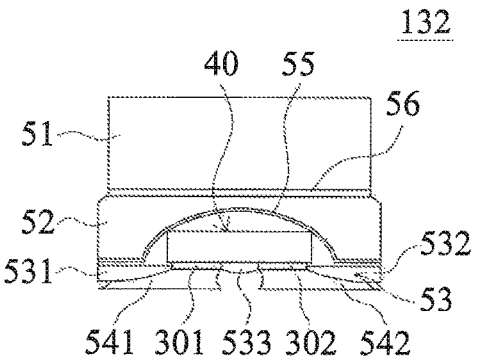

FIG. 5B shows a cross-sectional view of another embodiment of the light-emitting unit 132. The light-emitting unit 132 has a structure similar to that shown in FIG. 5A, except that a wavelength conversion layer 55 is provided within the first transparent structure 52. The wavelength conversion layer 55 comprises a transparent substance and a plurality of wavelength conversion particles dispersed therein. The transparent substance includes silicone or epoxy. The wavelength conversion particles are described as the aforementioned.

When the light-emitting unit 132 includes the wavelength conversion layer 55, the sealing member 138 can optionally include the wavelength conversion particles or diffusing particles to adjust the color temperature of the light-emitting device 13. For example, the light-emitting units 132, 133 with the wavelength conversion layer 55 have a color temperature of 5000~6500K. After providing the tube cover 137 enclosing the light-emitting units 132, 133, the sealing member 138 with the wavelength conversion particles is filled in the tube cover 137. The wavelength conversion particles can be provided to change the light-emitting device 13 with a color temperature less than 5000K or in a range of 2700~4500K. Alternatively, the light-emitting units 132, 133 with the wavelength conversion layer 55 have a color temperature of 2500~3000K. After providing the tube cover 137 enclosing the light-emitting units 132, 133, the sealing member 138 with the diffusing particles is filled in the tube cover 137. The diffusing particles can be provided to change the light-emitting device 13 with a color temperature in a range of 2700~3500K and the color temperature different with and without the diffusing particles is 200~500K. Of course, when the sealing member 138 without the wavelength conversion particles and the diffusing particles is filled in the tube cover 137, the light-emitting device 13 substantially has a color temperature same as that of the light-emitting units 132, 133.

Figure 5C:
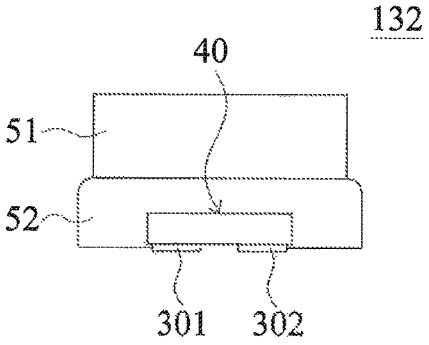
Figure 5D:
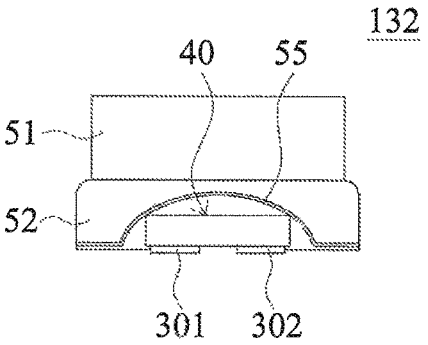

FIGS. 5C and 5D show a cross-sectional view of other embodiments of the light-emitting unit 132. The light-emitting units 132 have structures similar to that shown in FIGS. 5A and 5B, respectively, except that the light-emitting units 132 do not have the reflective layer and the pads. The first electrode 301 and the second electrode 302 are used to directly contact the circuit 139 of the carrier 131 (see FIG. 4B).

Figure 5E:
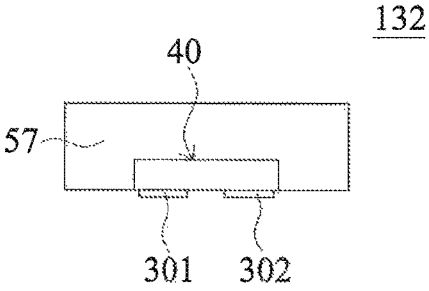

FIG. 5E show a cross-sectional view of another embodiment of the light-emitting unit 132. The light-emitting unit 132 includes a phosphor structure 57 enclosing the light-emitting element 40. The phosphor structure 57 includes a transparent substance and a plurality of wavelength conversion particles dispersed therein. The transparent substance includes silicone or epoxy. The wavelength conversion particles are described as the aforementioned. Alternatively, a plurality of diffusing particles can be included in the phosphor structure 57.

The light-emitting element 40 comprises a substrate, a first-type conductivity semiconductor layer, a second-type conductivity semiconductor layer, and an active layer sandwiched between the first-type and second-type conductivity semiconductor layer. The first-type and second-type conductivity semiconductor layers respectively provide electrons and holes such that electrons and holes can be combined in the active layer to emit light when a current is applied thereto. The material of the semiconductor layer and the active layer comprises III-V group semiconductor material, such as $Al_xIn_yGa_{(1-x-y)}N$ or $Al_xIn_yGa_{(1-x-y)}P$, wherein $0 \leq x, y \leq 1$; $(x+y) \leq 1$. Depending on the material of the active layer, the light-emitting element 40 is capable of emitting a red light with a peak wavelength in a range from 610 nm to 650 nm, a green light with a peak wavelength in a range from 530 nm to 570 nm, a blue light with a peak wavelength in a range from 450 nm to 490 nm or a UV light with a peak wavelength in a range from 400 nm to 450 nm. A method of making the light-emitting element 40 is not limited to but comprises Metal-organic Chemical Vapor Deposition (MOCVD), Molecular Beam Epitaxy (MBE), Hydride Vapour Phase Epitaxy (HVPE), evaporation or ion electroplating.

The foregoing description has been directed to the specific embodiments of this invention. It will be apparent to those having ordinary skill in the art that other alternatives and modifications can be made to the devices in accordance with the present disclosure without departing from the scope or spirit of the disclosure. In view of the foregoing, it is intended that the present disclosure covers modifications and variations of this disclosure provided they fall within the scope of the following claims and their equivalents.

What is claimed is:

1. A light-emitting apparatus comprising:

a first light-emitting device comprising:

a carrier having a surface;

a light-emitting unit formed on the surface;

an electrode plate formed on the surface; and a first cover having a hollow space for accommodating the light-emitting unit and the carrier, and not directly contacting the light-emitting unit and the carrier;

a second light-emitting device;

a second cover comprising a lateral opening for light transmission and a chamber for accommodating the first light-emitting device and the second light-emitting device; and a base associated with the first light-emitting device and the second light-emitting device, wherein the first light-emitting device and the second light-emitting device are arranged with respect to the base by angles towards different directions and wherein the electrode plate does not extend beyond the carrier in a lengthwise direction.

2. The light-emitting device of claim 1, wherein the second cover comprises a bottom.

3. The light-emitting device of claim 1, wherein an area ratio of the second opening to the second cover is in a range of 0.1-0.9.

4. The light-emitting bulb of claim 1, wherein the second opening is elongated.

5. The light-emitting bulb of claim 1, wherein the second cover further comprises a plurality of ribs interleaving in the plurality of second openings.

6. The light-emitting bulb of claim 1, wherein the first cover comprises glass, diamond, epoxy, quartz, acrylic resin, SiOX, $Al_2O_3$, ZnO or silicone.

7. The light-emitting bulb of claim 1, wherein the second cover comprises polypropylene, polybutylene terephthalate, poly(methyl methacrylate) or tempered glass.

8. The light-emitting bulb of claim 1, wherein the light-emitting unit comprises a light-emitting element, and a first transparent structure enclosing the light-emitting element.

9. The light-emitting bulb of claim 1, wherein the first cover comprises an open end and a closed end opposite to the open end.

10. The light-emitting bulb of claim 1, wherein the first light-emitting device has a color temperature same as that of the light-emitting unit.

11. The light-emitting bulb of claim 1, wherein the first light-emitting device has a color temperature different from that of the light-emitting unit.

12. The light-emitting bulb of claim 1, wherein the light-emitting unit comprises a light-emitting element, and a phosphor structure enclosing the light-emitting element.

13. The light-emitting bulb of claim 1, further comprising a sealing member formed in the hollow space to cover the carrier and the light-emitting unit.

14. The light-emitting device of claim 2, wherein the first light-emitting device is installed in the second cover through the bottom opening.

15. The light-emitting bulb of claim 2, wherein the second cover further comprises a top portion, the second opening extending from the top portion to the bottom end.

16. The light-emitting bulb of claim 5, wherein two of the plurality of ribs are separated from each other by the second opening.

17. The light-emitting bulb of claim 8, wherein the light-emitting unit further comprises a second transparent structure formed on the first transparent structure.

18. The light-emitting bulb of claim 9, wherein the carrier is exposed out of the open end.

19. The light-emitting bulb of claim 13, wherein the sealing member comprises wavelength conversion particles, diffusing particles, or both.

* * * * *